United States Patent [19]

Roder et al.

[11] Patent Number: 4,999,988

[45] Date of Patent: Mar. 19, 1991

[54] METHOD AND APPARATUS FOR CHANGING ROVEN BOBBINS FOR A TEXTILE MACHINE

[75] Inventors: Kurt Roder, Seuzach; Isidor Fritschi, Andelfingen; Kurt Buechi, Neubrunn, all of Switzerland

[73] Assignee: Rieter Machine Works, Ltd., Winterthur, Switzerland

[21] Appl. No.: 527,708

[22] Filed: May 21, 1990

Related U.S. Application Data

[63] Continuation of Ser. No. 259,249, Oct. 18, 1988, abandoned.

[30] Foreign Application Priority Data

Oct. 14, 1987 [CH] Switzerland ..... 04017/87

[51] Int. Cl.[5] ..... D01H 9/00

[52] U.S. Cl. ..... 57/281; 57/90

[58] Field of Search ..... 57/90, 268, 270, 276, 57/281; 242/35.5 H; 104/91

[56] References Cited

U.S. PATENT DOCUMENTS

| | | | |
|---|---|---|---|
| 412,976 | 10/1889 | O'Keeffe | 104/91 |
| 1,297,680 | 3/1919 | Hanak | 104/91 X |
| 2,580,758 | 1/1952 | Gibson | 104/91 X |
| 2,726,505 | 12/1955 | Bethune et al. | 57/281 |
| 2,845,034 | 7/1958 | Harrison | 104/91 X |
| 3,828,682 | 8/1974 | Klein | 57/281 X |
| 3,884,026 | 5/1975 | Yoshizawa et al. | 57/281 |
| 3,935,821 | 2/1976 | Maier et al. | 57/281 |
| 4,023,339 | 5/1977 | Laderach et al. | 57/268 |
| 4,630,435 | 12/1986 | Igel | 57/90 X |
| 4,735,042 | 4/1988 | Igel | 57/281 |
| 4,799,353 | 1/1989 | Kawasaki et al. | 57/276 X |

FOREIGN PATENT DOCUMENTS

| | | |
|---|---|---|
| 0240473 | 10/1987 | European Pat. Off. . |
| 2187959 | 1/1974 | France . |

*Primary Examiner*—Joseph J. Hail, III

*Attorney, Agent, or Firm*—Kenyon & Kenyon

[57] ABSTRACT

The carriers which carry the roving bobbins are moved from the conveyors which are parallel to the spinning machine on branches which extend laterally into the spinning machine to effect a bobbin changeover of transverse rows of bobbins in the machine. The branches extend angularly, for example, at angles of 45° to 90° to the center plane of the spinning machine and may extend to near the center plane or across the width of the machine.

21 Claims, 6 Drawing Sheets

FIG. 1
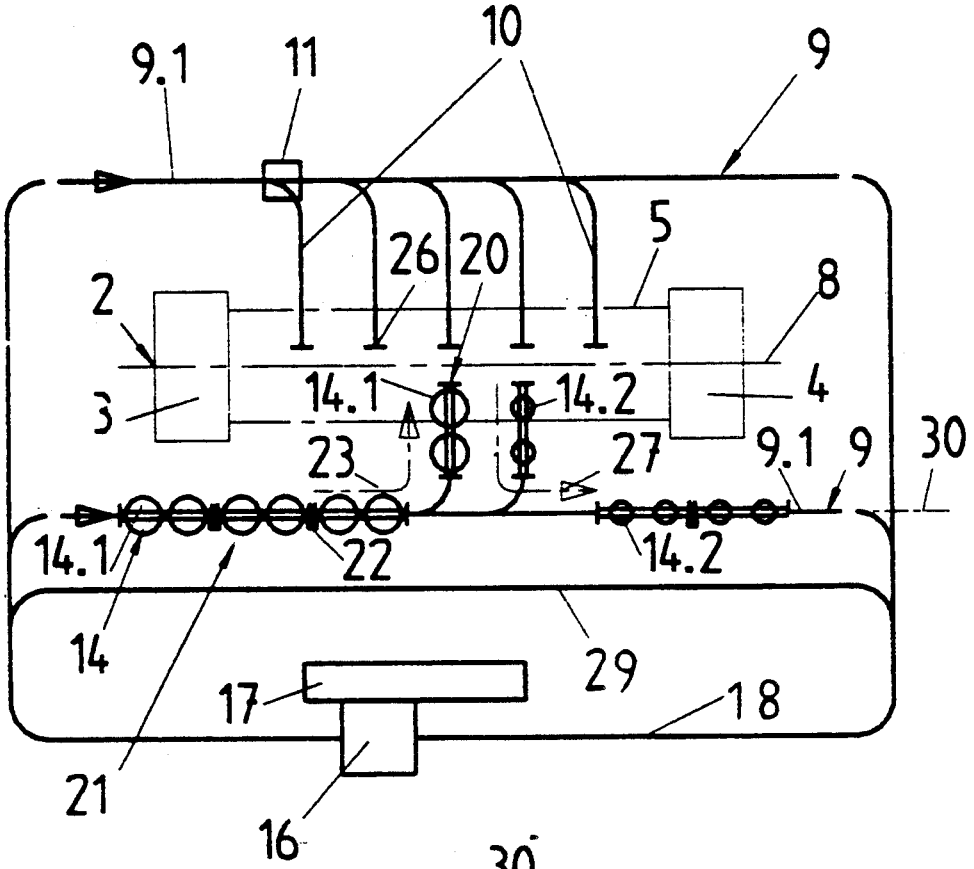
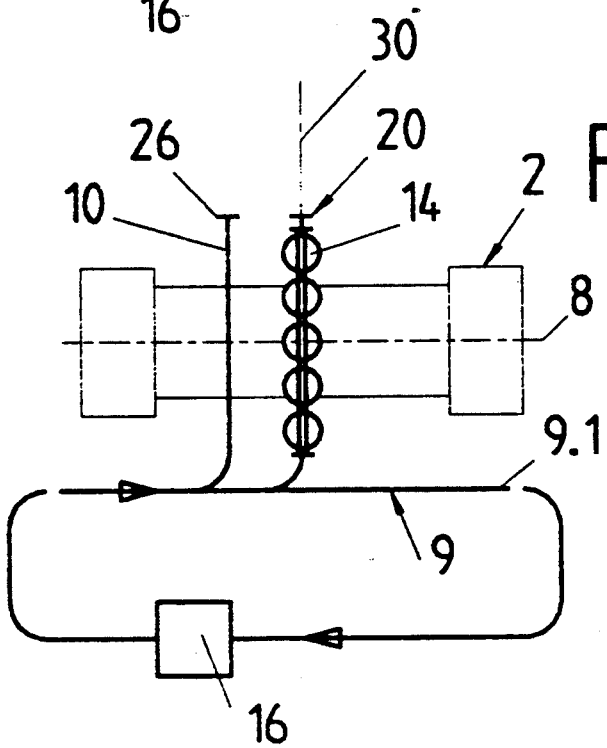
FIG. 2

METHOD AND APPARATUS FOR CHANGING ROVEN BOBBINS FOR A TEXTILE MACHINE

This application is a continuation of application Ser. No. 07/259,249, filed Oct. 18, 1988 now abandoned.

This invention relates to a method and apparatus for changing roving bobbins for at least one textile machine. More particularly, this invention relates to a method and apparatus for changing roving bobbins in a spinning frame.

Heretofore, various types of installations have been known for the transportation of filled spools or bobbins from one textile machine to another. Generally, these installations employ an overhead conveyor as a connection between two textile machines in order to convey filled bobbins to one machine while removing emptied bobbins from the machine for transfer back to the other machine. However, although there have been many feasible constructions and suggestions, the connection between a preliminary spinning machine or flyer and a spinning machine must still be regarded as unsatisfactory. For example, in some cases, use has been made of carrier trains of roving bobbins, the trains advancing on suspended rails from the flyer to before the creel of a spinning machine having, for example, four rows of creeled bobbins. The full bobbins of this train, which forms a reserve row of bobbins, must then be changed over to the production rows after the (almost) empty tubes have been removed, an operation involving laborious manual work. While the changeover can be performed at relatively great initial cost by a specially designed automatic machine which is movable on the floor along the spinning machine; this can be done only with the outer production row. Another automatic machine is therefore necessary which can move above the creel and which exchanges the bobbins of the inner row with those of the outer row while the sliver continues to move.

Swiss Patent 555,902 and corresponding U.S. Pat. No. 3,935,821, describes an overhead conveying arrangement which makes changeover unnecessary and in which carrier trains are introduced lengthwise into the creel. However, an elaborate vertical adjustment facility is necessary because of the vertical hindrances caused by the drive head and end head of the spinning machine. Further, should the drive head be made lower a number of disadvantages would arise which are associated with longitudinal entry without vertical adjustment. The point is that, in such a case, automation is essential, otherwise the carrier trains of the inner row cannot be moved. Dust and fluff structures may also drop unnoticed form the long carrier trains and clog up drafting heads, while sliver ends hanging down from the bobbins may scrape parts of the spinning machine, so that there is a risk of damage. Also, simultaneous piecing-up of the slivers within a reasonable time requires a high instantaneous concentration of operatives. The time taken to separate the moving slivers of a whole longitudinal row of bobbins, to move out the empty tubes and to introduce the full bobbins cannot readily be shortened and may require stoppage of the machine. More particularly, in the case of 6-row creeling, blockage by moving slivers would make it impossible for a carrier train to move unless additional action was taken.

German Patent Application 3,034,477 describes a bobbin-changing facility in which bobbin carrying carriers are so guided laterally towards the machine centerplane into the operative positions of the bobbins by means of an overhead conveyor extending along a machine that the longitudinal axis of each carrier always remains parallel to the conveyor and the longitudinal rows of bobbins are replaced in sections. This calls for an elaborate changing and lateral displacement device having two retaining means per carrier rotatable through 90° and engaging the carrier ends simultaneously. Further, moving the central longitudinal rows of bobbins in and out is complicated and time consuming.

Other types of conveying installations have also been described in U.S. Pat. No. 3,838,682 and European Patent Application 0240473. However, these installations have similar disadvantages to the above noted installations.

Accordingly it is an object of the invention to obviate manual changeover of bobbins in a textile machine.

It is another object of the invention to provide a low-cost apparatus capable of effecting a rapid bobbin changeover in a textile machine.

It is another object of the invention to avoid work peaks during bobbin or slubbing changing in a textile machine.

It is another object of the invention to obtain a reliable bobbin changeover in a textile machine.

Briefly, the invention provides a method and apparatus for changing roving bobbins in a textile machine, such as a creel, employing an overhead conveyor.

In accordance with the method, a bobbin carrying carrier is moved on a conveyor which extends lengthwise of the machine and is guided horizontally of the conveyor so that a longitudinal axis of the carrier experiences a horizontal change of direction to place an entrained full bobbin in an operative position on the machine and to remove an entrained empty bobbin from an operative position on the machine.

The apparatus of the invention includes at least one overhead conveyor which extends longitudinally of a center plane of the textile machine, a plurality of carriers for roving bobbins movable along a conveyor and a plurality of branches extending from the conveyor angularly of the center plane for guiding the carriers laterally of the operative positions.

Since the carrier moves laterally into the creel instead of moving parallel thereto there is no need for lateral shifting facilities, thus reducing costs since only monorail branches are needed. Also, since only one transverse row of bobbins need be changed at a time, the number of sliver ends to be changed at a time is reduced and the operation can be performed rapidly just by one or two operatives. Labor peaks, with their need for a temporary build-up of operatives, therefore do not occur. The carrier or a carrier train can readily be advanced by one person, for example, by means of a dependent device but automation using, for example, friction conveying rollers and automatic coupling and uncoupling elements is readily possible.

The method and apparatus also permit an operative to easily keep a check on a transverse row of bobbins for dropping collections of fluff and rubbing and entangling of operation rather than on a longitudinal row of bobbins. Hence, reliability of operation in bobbin changing is increased.

The change of direction of the branches relative to the conveyor is in a range of between 45° and 90°. A change of direction of either 45° (corresponding to an angle of inclination, considered in the direction of feed movement, between the branch and the overhead conveyor of 135°) or 90° is the most convenient. A conventional transverse row of bobbins aligned transversely to the machine center-plane is suitable for the 90° variant while the 45° variant facilitates carrier entry because of the reduced curve and because machine width is reduced, a consideration which may be important particularly in the case of 6-row creeling.

In order to use thicker bobbin packages, the carrier may be arranged such that a carrier carrying a full bobbin and a carrier carrying a half-full bobbin are moved in alternating paths to the operative positions of the textile machine.

The apparatus may employ one conveyor with branches which extend across the width of a textile machine or multiple conveyors with branches which extend to near the center-plane of a textile machine or across the width of the machine.

These and other objects and advantages of the invention will become more apparent from the following detailed description taken in conjunction with the accompanying drawings wherein:

FIG. 1 illustrates a plan view of a textile machine having 4-row creeling in a first embodiment of the invention;

FIG. 2 illustrates a simplified plan view of a textile machine having 5-row creeling in a second embodiment of the invention;

Figure 3:
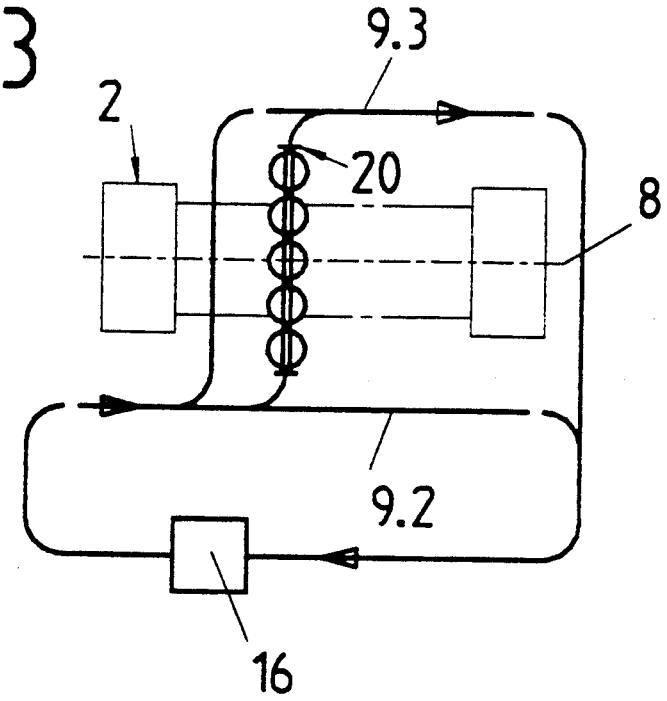
FIG. 3 illustrates a simplified plan view of a third embodiment of the invention.

Referring to FIG. 1, a spinning machine 2 is provided for 4-row creeling and comprises a drive head 3, an end head 4 and a creel 5. An overhead conveyor 9 extends along the machine 2 parallel to a center-plane 8 thereof on each long side of the machine 2 and is connected by way of junctions 11 to branches 10 which are disposed at right-angles to the plane 8 and which extend as far as the plane 8. The overhead conveyors 9, whose length sections are indicated in the drawings by line interruptions, and the branches 10 extend substantially in a horizontal plane, possibly with a slight downwards inclination of the branches 10 towards the plane 8, and at a level corresponding to the normal operative positions of roving bobbins 14.

An endless closed-loop overhead conveyor 18 is connected with the two overhead conveyors 9 and is loaded with a plurality of carriers 20, such as trolleys, trucks, or the like. The carriers 20 are loaded onto the conveyor 18 with full roving bobbins 14.1 at a charging station 16 of a flyer 17 and marshalled into a train 21 by means of releasable couplings 22. The trains 21 are guided onto the overhead conveyors 9 either automatically, by means of driving wheel devices or conveyor chains, or manually, for example, by means of a handle hanging down from the carrier 20.

To reload the machine, a releasable coupling 22 is released, the junction 11 changed over and a carrier 20 carrying two full bobbins 14.1 is moved, in the direction indicated by an arrow 23 denoting the entry direction, onto a branch 10, a separate branch being provided for each transverse row of bobbins. After the slivers have been connected, the next carrier 20 is detached from the train 21 and moved on to the next branch 10. Consequently, only two full roving bobbins 14.1 at a time are moved as far as an end stop 26 secured to each branch 10, changeover of the bobbins being unnecessary since the bobbins 14 hanging on the carrier 20 adjacent the end stops 26 are disposed in their operative positions on the branch 10. When one long side of the machine 2 has been serviced, the operator can place the bobbins on the other long side of the machine into their operative positions. A branch 10 therefore extends by way of the operative positions of a transverse row of bobbins and branch length depends upon the distance between the overhead conveyor 9 and the machine center-plane 8.

In operation, the empty bobbins 14.2 must first be removed via the carriers 20 onto the same overhead conveyor 9 in a direction opposite to the entry direction—as indicated by an arrow 27—before the full bobbins 14.1 can enter. In this case, therefore, the conveyors 9 are each operative as a common supply and removal conveyor 9.1. The empty bobbins 14.2 are marshalled to form a carrier train 21, preferably by means of automatic couplings 22, and the train moves to the loading station 16 of the flyer 17. The overhead conveyor system can, of course, have one or more passing loops 29 or other facilities.

Referring to FIG. 2, a single conveyor 9 may be disposed on only one side of the textile machine 2 to serve as a common supply and removal conveyor 9.1. The branches 10, accordingly, extend over the whole width of the machine 2 and each carrier 20 carries a number of roving bobbins 14 equal to the number of rows of operative positions in the machine 2, for example, five roving bobbins 14. From the conveyor 9 to the branch 10, a longitudinal axis 30 of each carrier 20 experiences a 90° change of direction to place an entrained full bobbin 14 in an operative position.

Referring to FIG. 3, the installation may be constructed with a separate supply conveyor 9.2 and a separate removal conveyor 9.3 which extends along opposite long sides of the machine 2, so that the carriers 20 can depart in the entry direction, which is also the exit direction.

Figure 4:
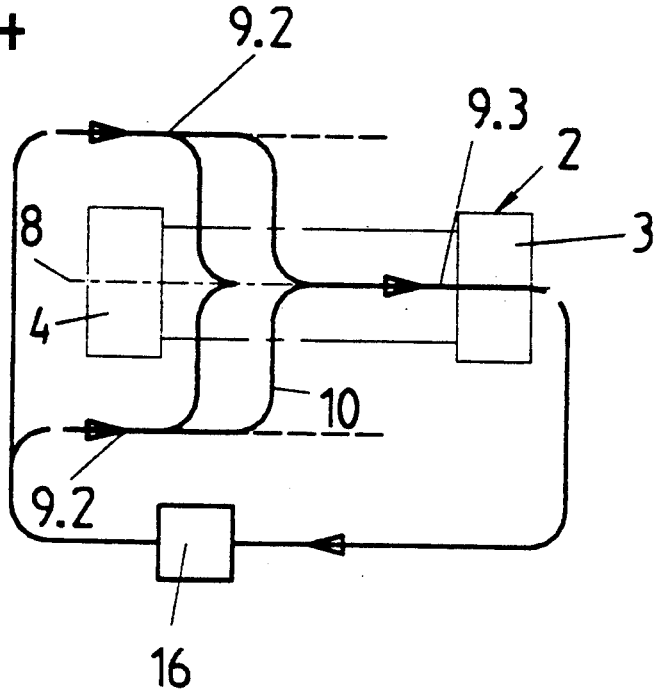
FIG. 4 illustrates a simplified plan view of a textile machine in a fourth embodiment of the invention.

Referring to FIG. 4, wherein like reference characters indicate like parts as above, a pair of supply conveyors 9.2 is provided on opposite longitudinal sides of the machine 2 in parallel to the center plane 8 while a removal conveyor 9.3 common to both extends near the center-plane 8 and beyond the end part of the machine. Such end part is the drive head 3, whose overall height is usually relatively low but can, of course, be the end head 4 if the overall height permits.

Figure 5:
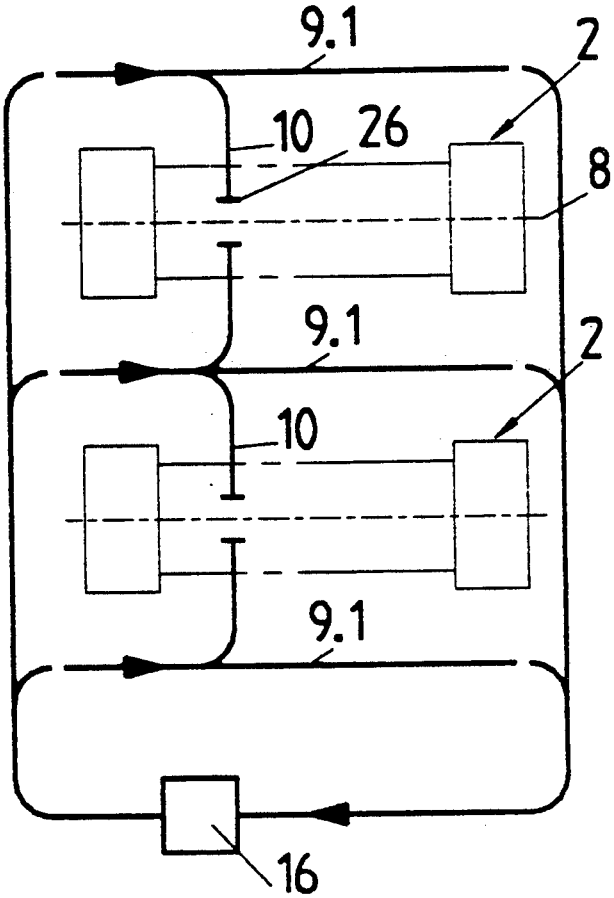
FIG. 5 illustrates a simplified plane view of two textile machines in a fifth embodiment which is similar to a first embodiment.

Referring to FIG. 5, three parallel conveyors 9.1 may be disposed between two textile machines 2 of a plant with the middle conveyor 9.1 acting as a common supply and removal conveyor for the two machines 2. This construction may be convenient if the travelling blower (not shown) does not cause problems.

Figure 6:
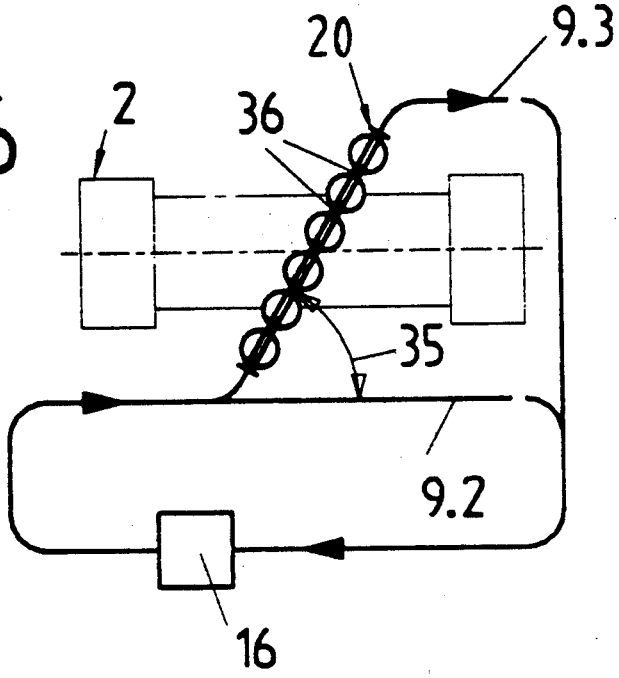
FIG. 6 illustrates a simplified plan view of a textile machine having 6-row creeling in a sixth embodiment.

Referring to FIG. 6, the installation which is similar to the embodiment of FIG. 3 may have branches 10 with a change of direction of 45° (angle 35). As indicated each carrier 20 carries six roving bobbins 14 and, to facilitate entry and exit, each carrier 20 has pivots 36 between the bobbins 14.

Figure 7:
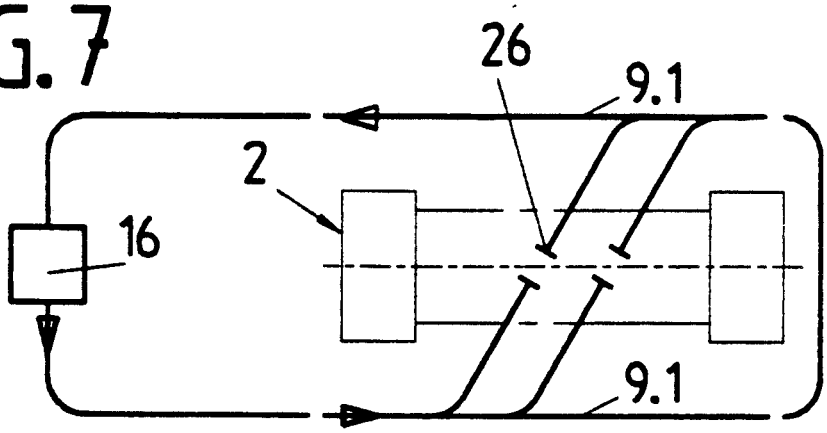
FIG. 7 illustrates a simplified plan view of a textile machine in a seventh embodiment.

FIG. 7 illustrates an installation which is similar to the embodiment of FIG. 1 and in which the bobbins enter at an inclination as in FIG. 6 and in which the two conveyors 9.1 are disposed for opposite travel of the carriers as indicated by the arrows.

The foregoing description relates only to carriers 20 having bobbins 14 which are disposed consecutively as considered in the direction of movement. A transverse row of bobbins which extends as far as the center-plane 8 comprises for practical reasons at least two roving bobbins 14. Therefore, carriers 20 are loaded with two bobbins 14 in the embodiment of FIG. 1. When two carriers 20, each carrying one bobbin 14, move on to the same branch 10, such two carriers are regarded as one carrier for the purposes expressed above.

Figure 8:
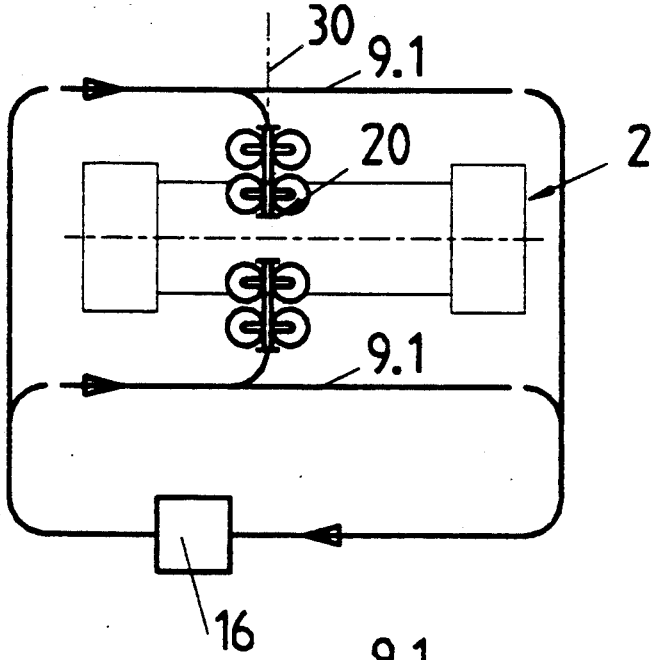
FIG. 8 illustrates a simplified view of a textile machine having 4-row creeling in an eighth embodiment.
Figure 11:
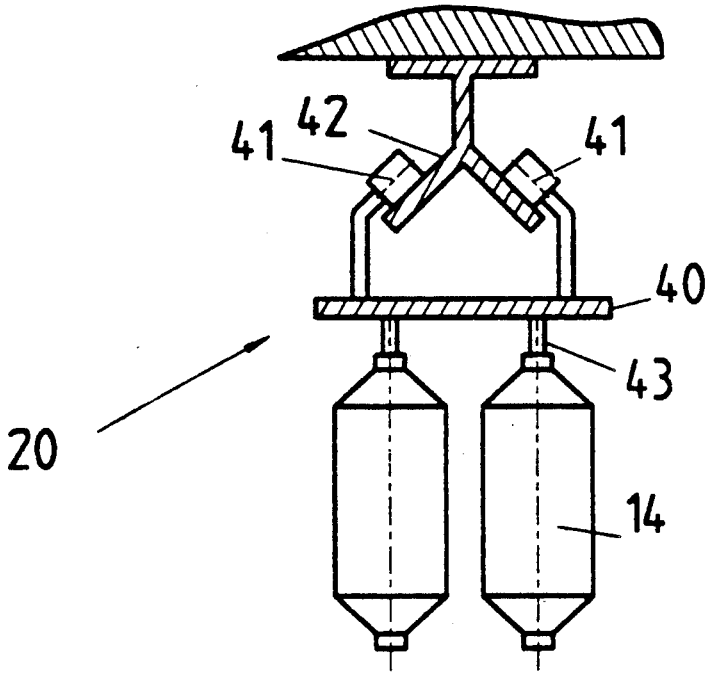
FIG. 11 illustrates a front view of a carrier on an overhead conveyor with bobbins disposed adjacent one another in two rows in the movement direction.

Referring to FIG. 8, each carrier 20 may be constructed for use in a machine 2 having 4-row creeling and, to this end, carries four roving bobbins 14 which are disposed adjacent one another in double rows, as considered in the direction of movement and which are aligned parallel to one another upon a 90° change of direction, as is also shown in FIG. 11.

Figure 9:
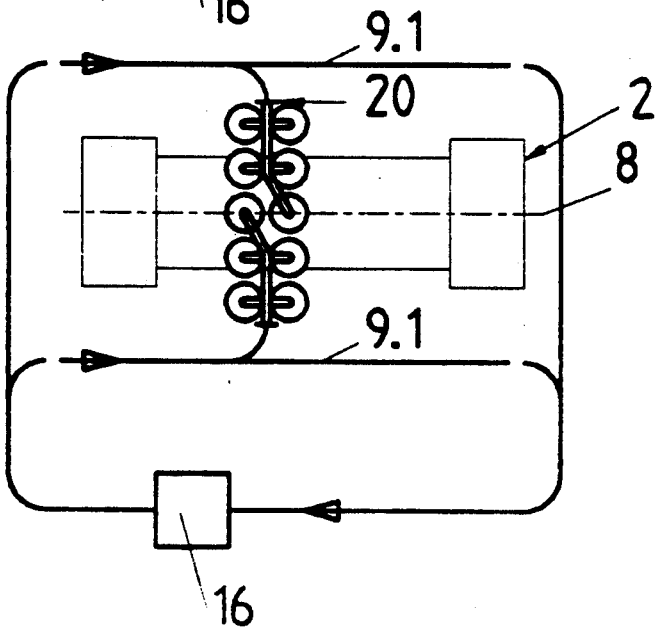
FIG. 9 illustrates a simplified plan view of a textile machine having 5-row creeling in a ninth embodiment similar to the eighth embodiment.

Referring to FIG. 9, where the textile machine 2 has 5 row creeling, each carrier 20 is constructed, for example such that two bobbins 14 are disposed opposite three bobbins 14 as considered in the direction of movement, the odd bobbin 14 and the corresponding bobbin 14 of a carrier 20 on the other long side of the machine 2, having their operative positions on the center-plane 8. In this case, the two carriers 20 are movable not as far as the plane 8 but into the region of the plane 8.

Figure 10:
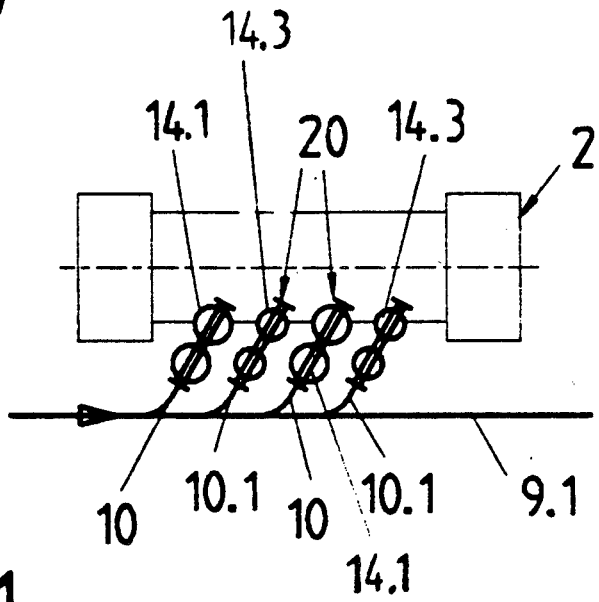
FIG. 10 illustrates a plan view of a tenth embodiment similar to that of FIG. 7.

Referring to FIG. 10, for the sake of possibly better operation, a carrier 20 carrying full bobbins 14.1 may be moved into every other branch 10 while a carrier having half-full bobbins 14.3 is moved into the alternating branches 10. Conveniently, therefore—but not necessarily—every other branch 10 is first filled with full bobbins 14.1 and only subsequently are all the intermediate branches 10.1 occupied by half full bobbins 14.3. Also, larger packages i.e., larger diameter packages, can be used in this method.

Referring to FIG. 11, a carrier 20 may be constructed with a carrier plate or disc 40 and an even number of rollers 41 which roll on an overhead rail 42 of the conveyor 9 and branch 10. An odd or even number of hanging pins 43 for carrying the bobbins 14 are provided on the underside of the plate 40.

Figure 12:
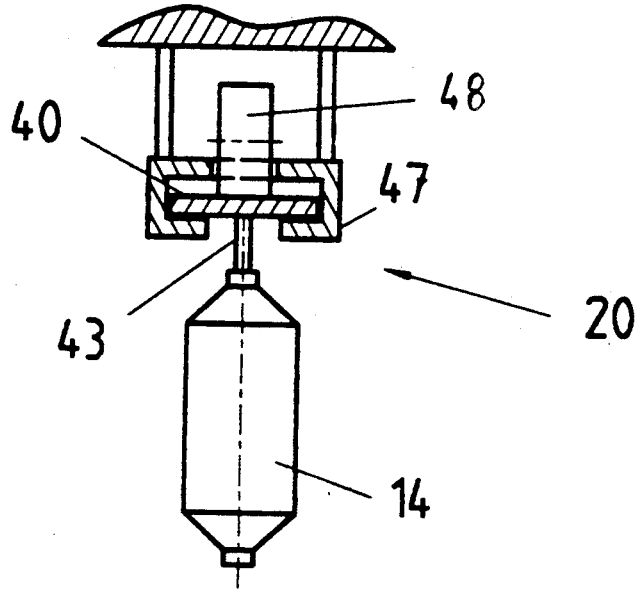
FIG. 12 illustrates a front view of a modified carrier on an overhead conveyor with bobbins disposed consecutively in the movement direction.

Referring to FIG. 12, a carrier 20 may alternatively be constructed with a carrier plate 40 which slides in a rail 47 open at the bottom. If required, a driving friction roller 48 can be provided in known manner. An odd or even number of pins 43 can be provided on the bottom of the plate 40.

Figure 13:
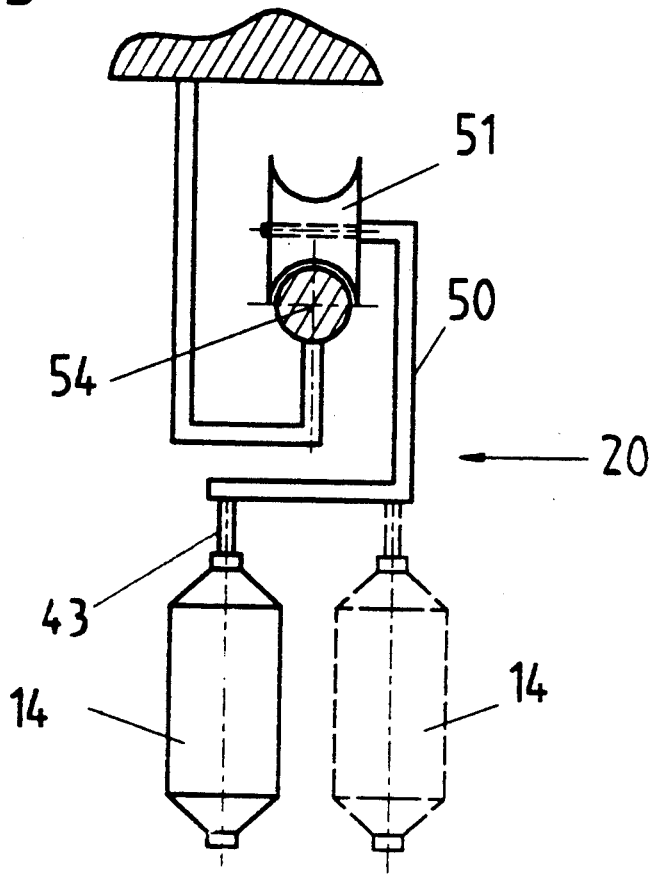
FIG. 13 illustrates a front view of a further carrier on an overhead conveyor in which the bobbins are disposed adjacent one another or consecutively as considered in the movement direction.

Referring to FIG. 13, the carrier 20 may be constructed with a stirrup 50 which rides via the interposition of one or more rollers 51 on a circular cross-section hanging or carrying rail 54. A number of pins 43 can be provided in consecutive or adjacent relationship (indicated by a bobbin 14 shown in chain lines) on the stirrup 50.

Clearly, arrangements other than those shown are possible. For example, the arrangement of FIG. 4 can be combined with the arrangement of FIGS. 7, 8, or 9.

The invention thus provides a relatively low cost arrangement capable of effecting a rapid bobbin changeover in a textile arrangement. Further, the arrangement reduces the risks of soiling of the textile machine by falling fluff as well as of entanglement of silver during a changeover.

What is claimed is:

1. In a method of changing roving bobbins in at least one textile machine of a plurality of textile machines in a plant, each textile machine having a plurality of operative roving positions along a longitudinal axis, said method comprising the steps of moving a bobbin-carrying carrier on at least one overhead conveyor extending lengthwise of said longitudinal axis of at least one machine; and guiding the carrier horizontally from the conveyor towards said one machine, said guiding causing a change in the longitudinal axis of the carrier in a horizontal direction and positioning of the carrier to place an entrained full bobbin in an operative position on the machine.

2. A method as set forth in claim 1 wherein said change of direction occurs over an angle between 45° and 90°.

3. A method as set forth in claim 1 which further comprises the step of moving a carrier carrying a full bobbin and a carrier carrying a half-full bobbin in alternating paths to the operative positions of the machine.

4. A method as set forth in claim 1 which further comprises the step of moving the carrier horizontally of the conveyor with an emptied bobbin thereon from the machine onto the conveyor.

5. A method as set forth in claim 3 which further comprises the steps of coupling a plurality of the carriers together to form a train on the conveyor, uncoupling and guiding a carrier carrying full bobbins from the train with a change of direction onto a separate track for disposition over said operative positions and guiding a carrier carrying empty bobbins with a change of direction from said separate track onto the conveyor for coupling with other carriers to form a train.

6. A method as set forth in claim 5 which further comprises the step of moving each carrier carrying empty bobbins from said separate track in a direction opposite an entry direction onto said conveyor.

7. A method as set forth in claim 5 which further comprises the step of moving each carrier carrying empty bobbins from said separate track onto a second overhead conveyor.

8. In a plant having a plurality of textile machines, the combination comprising at least one textile machine having a plurality of operative positions for roving bobbins disposed along a center plane;

at least one overhead conveyor extending longitudinally of said center plane of said textile machine;

a plurality of carriers for roving bobbins movable along said conveyor; and a plurality of branches extending from said conveyor angularly of said center plane and above said operative positions for guiding said carriers thereon for at least one of supply to and removal from over said operative positions.

9. The combination as set forth in claim 8 which comprises a pair of said conveyors, each said conveyor extending on an opposite side of said center plane and wherein said branches extend from each respective conveyor to near said center plane.

10. The combination as set forth in claim 9 which further comprises a third conveyor extending along said center plane and connected to said branches for removing carriers therefrom.

11. The combination as set forth in claim 8 which comprises a pair of said conveyors, each said conveyor extending on an opposite side of said center plane and wherein said branches extend between said conveyors over the width of said machine.

12. The combination as set forth in claim 8 wherein said branches extend over the width of said machine.

13. The combination as set forth in claim 8 comprising a pair of said textile machines disposed in parallel relation with said conveyor disposed in parallel therebetween and said branches extending angularly over each respective machine.

14. The combination as set forth in claim 8 wherein said carrier has from two to six bobbins disposed in the direction of movement of said carrier.

15. The combination as set forth in claim 8 wherein each carrier has two rows of from two to six bobbins disposed in the direction of movement of said carrier.

16. In a plant having a plurality of textile machines, the combination comprising a textile machine having a plurality of operative positions for roving bobbins disposed along a center plane;

at least one overhead conveyor extending longitudinally of said center plane of said textile machine;

a plurality of carriers for roving bobbins movable along said conveyor; and a plurality of branches extending from said conveyor transversely of said center plane and above said operative positions for guiding said carrier laterally of said operating positions

17. The combination as set forth in claim 16 wherein said branches extend at an angle to said center plane in a range of from 45° to 90°.

18. The combination as set forth in claim 16 which comprises a pair of said conveyors, each said conveyor extending on an opposite side of said center plane and wherein said branches extend from each respective conveyor to at least near said center plane.

19. The combination as set forth in claim 18 which further comprises a third conveyor extending along said center plane and connected to said branches for removing carriers therefrom.

20. The combination as set forth in claim 16 comprising a pair of said textile machines disposed in parallel relation with said conveyor disposed in parallel therebetween and said branches extending angularly over each respective machine.

21. In combination a spinning machine having a creel extending along a longitudinal axis, said creel including longitudinal rows of operative positions parallel to said axis;

an overhead conveyor extending along said machine parallel to said axis;

a plurality of branches extending from said conveyor transversely of said axis, each said branch being disposed along at least one respective transverse row of said operative positions; and a plurality of carriers and roving bobbins movable along said conveyor for selective movement onto each respective branch, each carrier having at least two bobbins in at least one row thereon in the direction of movement of said carrier for disposition of the row of bobbins at respective transverse rows of operative positions of said creel.

* * * * *

UNITED STATES PATENT AND TRADEMARK OFFICE

CERTIFICATE OF CORRECTION

PATENT NO. : 4,999,988

DATED : March 19, 1991

INVENTOR(S) : Kurt Roder, et al

It is certified that error appears in the above-indentified patent and that said Letters Patent is hereby corrected as shown below:

On the title page, Item [54]: change "ROVEN" to --ROVING--.
Column 1, line 2, change "ROVEN" to --ROVING--.
Column 6, line 45, change "3" to --4--.
Column 8, line 34, change "and" to --for--

Signed and Sealed this

Twenty-first Day of June, 1994

*Attest:*

Bruce Lehman

BRUCE LEHMAN

*Attesting Officer*

*Commissioner of Patents and Trademarks*